US007747186B2

(12) United States Patent
Miyamoto et al.

(10) Patent No.: US 7,747,186 B2
(45) Date of Patent: Jun. 29, 2010

(54) IMAGE FORMING APPARATUS INCLUDING A COOLING MECHANISM CONFIGURED TO APPLY COOLING PROCESSING TO A TRANSFER BELT

(75) Inventors: Teruyuki Miyamoto, Osaka (JP); Chisato Hatakeyama, Osaka (JP); Tomohide Hozono, Osaka (JP)

(73) Assignee: Kyocera Mita Corporation (JP)

( * ) Notice: Subject to any disclaimer, the term of this patent is extended or adjusted under 35 U.S.C. 154(b) by 696 days.

(21) Appl. No.: 11/713,159

(22) Filed: Mar. 2, 2007

(65) Prior Publication Data

US 2007/0212104 A1 Sep. 13, 2007

(30) Foreign Application Priority Data

Mar. 7, 2006 (JP) ..... 2006-060687

(51) Int. Cl.
*G03G 21/20* (2006.01)
*G03G 15/01* (2006.01)

(52) U.S. Cl. ..... 399/92; 399/302

(58) Field of Classification Search ..... 399/92, 399/94, 299, 302
See application file for complete search history.

(56) References Cited

U.S. PATENT DOCUMENTS 7,486,904 B2 * 2/2009 Sato et al. ..... 399/92
7,526,223 B2 * 4/2009 Adachi et al. ..... 399/92

FOREIGN PATENT DOCUMENTS

| | | |
|---|---|---|
| JP | 2003-029540 | 1/2003 |
| JP | 2001-296755 | 10/2004 |
| JP | 2004-361626 | 12/2004 |
| JP | 2005-241934 | 9/2005 |

OTHER PUBLICATIONS

Chinese Office Action.

* cited by examiner

*Primary Examiner*—William J Royer
(74) *Attorney, Agent, or Firm*—Gerald E. Hespos; Anthony J Casella

(57) ABSTRACT

An image forming apparatus includes photoconductive drums aligned side by side for toner images in colors to be formed on peripheral surfaces thereof. A transfer belt turns while stretched over rollers for the toner images to be transferred thereon by being superimposed one another as a surface thereof abuts on the peripheral surfaces of the photoconductive drums. A transfer roller transfers the toner images from the transfer belt onto a recording sheet. The transfer belt uses the position of the transfer roller as a turning position and turns to have a first side that moves in a first direction towards the turning position while abutting the peripheral surfaces of the photoconductive drums and a second side that moves opposite to the first direction using the turning position as a starting point. A cooling mechanism cools the transfer belt by circulating taken-in outside air along a surface of the second side.

5 Claims, 4 Drawing Sheets

IMAGE FORMING APPARATUS INCLUDING A COOLING MECHANISM CONFIGURED TO APPLY COOLING PROCESSING TO A TRANSFER BELT

BACKGROUND OF THE INVENTION

1. Field of the Invention

The present invention relates to a so-called tandem type image forming apparatus capable of performing color printing.

2. Description of the Background Art

Conventionally, a so-called tandem type image forming apparatus 100 capable of performing color printing as shown in FIG. 4 has been known. The image forming apparatus 100 includes plural photoconductive drums 101 for respective colors aligned side by side (yellow drum 101Y, magenta drum 101M, cyan drum 101C, and black drum 101K), and a transfer belt 104 disposed beneath the respective photoconductive drums 101 and turning around a pair of side rollers 102 and 103. The surface of an upper side 104*a* of the transfer belt 104 abuts on the peripheral surfaces of the respective photoconductive drums 101. At a center portion of a lower side 104*b* of the transfer belt 104, an intermediate roller 105 and a transfer roller 106 disposed oppositely to the intermediate roller 105 via the transfer belt 104 are provided. A charger, an exposing device, a developing device, a cleaning device, and so forth are provided on the periphery of each photoconductive drum 101, all of which are omitted in FIG. 4.

As the transfer belt 104 turns, toner images on the photoconductive drums 101 for respective colors are superimposed one on another on the surface thereof to form a color image. A recording sheet P is sent from a sheet cassette 107 to a nip portion between the intermediate roller 105 and the transfer roller 106 in synchronism with an action that a portion of the transfer belt 104 bearing the color image thus formed passes by the nip portion. The color image formed on the surface of the transfer belt 104 is thus transferred onto the recording sheet P. The recording sheet P done with the transfer processing is then subjected to fixing processing by heating for the toner image in a fixing device 108 provided directly downstream from the nip portion. Subsequently, the recording sheet P is discharged toward a sheet discharge tray 100*a*.

In the image forming apparatus 100 configured as above, each photoconductive drum 101 is heated due to application of a voltage from the charger and irradiation of a laser beam from the exposing device. In some cases, the transfer belt 104 is overheated when heat is transmitted from the respective photoconductive drums 101 or when it is irradiated to radiation heat generated in the fixing device 108. When the transfer belt 104 is overheated, there occurs an inconvenience that toner particles on the transfer belt 104 melt and are firmly fixed onto the transfer belt 104. Further, it is no longer possible to apply cooling processing to the photoconductive drums 101 via the transfer belt 104, which causes another inconvenience that image forming processing on the peripheral surfaces of the photoconductive drums 101 is adversely affected.

In order to prevent the occurrence of such inconveniences, it has been known to provide a cooling mechanism, in which a cooling fan 109 is disposed in close proximity to the lower side 104*b* and outside air taken in by the driving of the cooling fan 109 is blown on the surface of the lower side 104*b*. An image forming apparatus provided with such a cooling mechanism is disclosed, for example, in JP-A-2001-296755, JP-A-2003-29540, and JP-A-2004-361626.

In the image forming apparatus 100 shown in FIG. 4, however, the intermediate roller 105 and the transfer roller 106 are provided at the center portion of the lower side 104*b* of the transfer belt 104. Because these rollers 105 and 106 block air sent from the cooling fan 109, it is possible to supply only a half of the lower side 104*b* with the air sent from the cooling fan 109. Hence, the cooling mechanism in the conventional art has a problem that it fails to apply the cooling processing to the transfer belt 104 effectively.

SUMMARY OF THE INVENTION

An advantage of the invention is to provide an image forming apparatus capable of applying cooling processing to the transfer belt more efficiently.

An image forming apparatus according to one aspect of the invention that achieves the advantage includes: plural photoconductive drums aligned side by side for toner images in respective colors to be formed on peripheral surfaces thereof; a transfer belt configured to turn while being stretched over a specific number of rollers for the respective toner images to be transferred thereon by being superimposed on one another as a surface thereof abuts on the peripheral surfaces of the respective photoconductive drums; a transfer roller configured to transfer the toner images having been transferred onto the surface of the transfer belt onto a recording sheet; and a cooling mechanism configured to apply cooling processing to the transfer belt using taken-in outside air, wherein the transfer belt uses a position at which the transfer roller is disposed as a turning position and is turned to have a first side that moves in a first direction heading for the turning position while abutting on the peripheral surfaces of the respective photoconductive drums and a second side that moves in a second direction opposite to the first direction using the turning position as a starting point, and the cooling mechanism applies the cooling processing to the transfer belt by circulating the taken-in outside air along a surface of the second side.

DETAILED DESCRIPTION OF THE PREFERRED EMBODIMENTS

Figure 1:
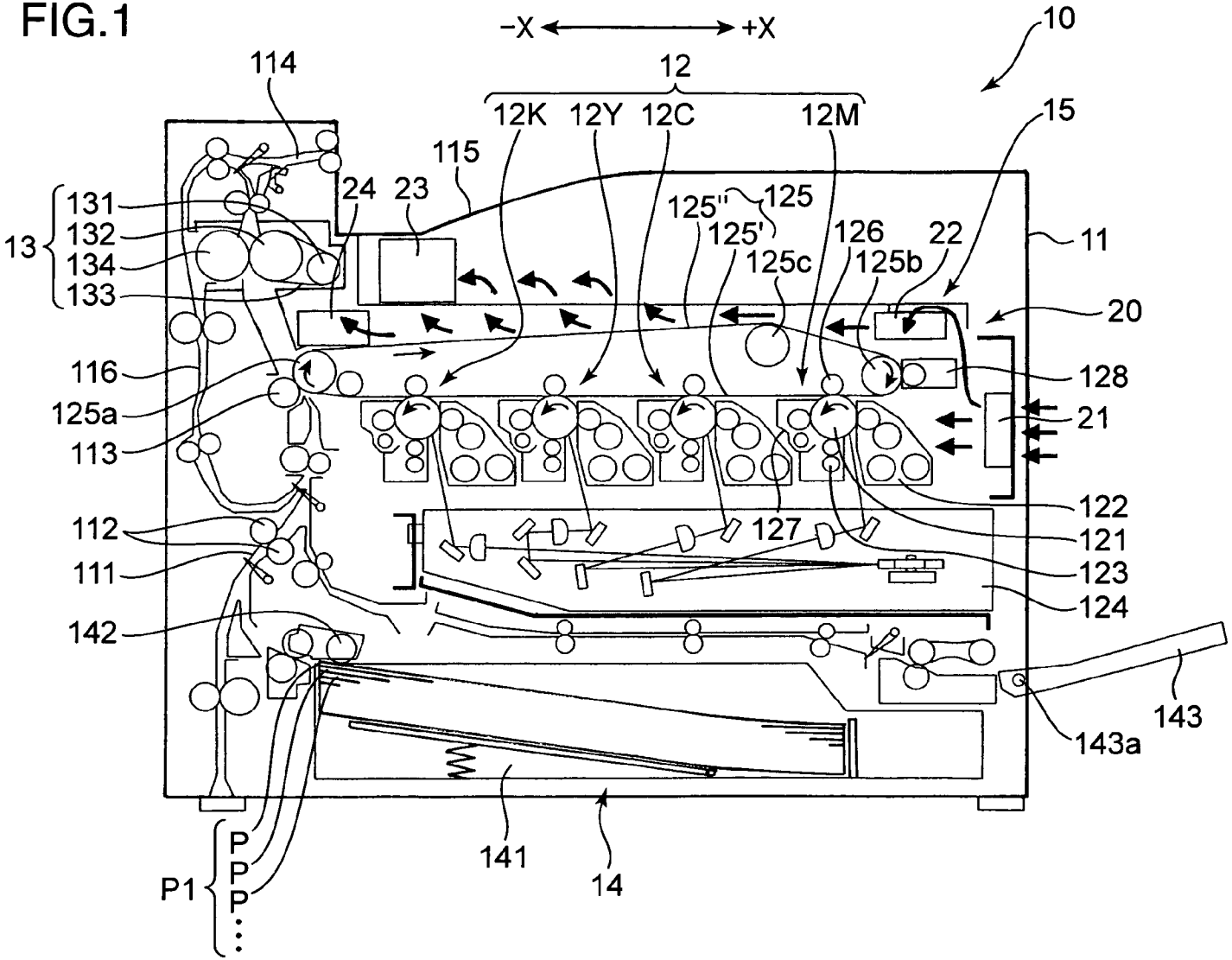
FIG. 1 is a sectional front view used to describe the inner structure of a printer according to one embodiment of the invention.

FIG. 1 is an explanatory view showing a printer 10 (image forming apparatus) according to one embodiment of the invention when viewed in a cross-sectional transverse plane. Referring to FIG. 1, the −X direction is defined as the left and the +X direction is defined as the right. The printer 10 is formed of a box-shaped apparatus main body 11, an image forming portion 12 that forms an image according to image information transmitted from an outside device, such as a computer, a fixing portion 13 that applies fixing processing to an image formed by the image forming portion 12 and transferred onto a recording sheet, a sheet storing portion 14 that stores recording sheets for transferring use, and a cooling mechanism 20 that applies cooling processing to the inside of the apparatus main body 11, of which the last four components are installed inside the apparatus main body 11.

The image forming portion 12 is to form a toner image on a recording sheet fed from the sheet storing portion 14. In this embodiment, it includes a unit 12M for magenta, a unit 12C for cyan, a unit 12Y for yellow, and a unit 12K for black that are sequentially disposed from upstream (the +X direction in FIG. 1) to downstream.

Each of the units 12M, 12C, 12Y, and 12K is provided with a photoconductive drum 121 and a developing device 122. Each photoconductive drum 121 is supplied with toner particles from the corresponding developing device 122 while it rotates in a counter-clockwise direction in FIG. 1. Each developing device 122 is replenished with toner particles from an unillustrated toner cartridge provided on the front side of the apparatus main body 11 (the front side of the sheet surface of FIG. 1).

A charging device 123 is provided at a position directly below each photoconductive drum 121, and an exposing device 124 is provided at a position below the charging devices 123. The peripheral surface of each photoconductive drum 121 is charged uniformly by the corresponding charging device 123. Laser beams for the corresponding colors according to the image data inputted from the outside device, such as a computer, are irradiated from the exposing device 124 to the charged peripheral surfaces of the respective photoconductive drums 121. Consequently, an electrostatic latent image is formed on the peripheral surface of each photoconductive drum 121. A toner image is then formed on the peripheral surface of the photoconductive drum 121 as toner particles are supplied to the electrostatic latent image from the developing device 122.

A transfer belt 125 serving as an intermediate transfer body is provided at a position above the respective photoconductive drums 121. The transfer belt 125 is stretched over a drive roller 125*a* provided at the upper left portion from the unit 12K for black and a driven roller 125*b* provided at the upper right portion from the unit 12M for magenta.

The drive roller 125*a* is disposed oppositely to a second transfer roller 113 (transfer roller in the appended claims). The transfer belt 125 is turned using the drive roller 125*a* at the position at which the second transfer roller 113 is disposed and the driven roller 125*b* as the turning positions. In reference to these turning positions, the transfer belt 125 has a first side 125' (lower side) whose surface abuts on each photoconductive drum 121 and a second side 125" (upper side) whose surface is cooled by the cooling mechanism 20.

The drive roller 125*a* is rotated about a central axis thereof in a clockwise direction. This allows the first side 125' of the transfer belt 125 to move to the left (first direction) while abutting on the peripheral surface of each photoconductive drum 121 from the driven roller 125*b* set as the starting point. Meanwhile, the second side 125" moves to the right (second direction) from the drive roller 125*a* set as the starting point. In short, the transfer belt 125 turns around the drive roller 125*a* and the driven roller 125*b* in a clockwise direction.

A tension roller 125*c* is provided beneath the second side 125". The tension roller 125*c* is disposed at a slightly leftward position from the unit 12M for magenta, and confers tension to the transfer belt 125 by lifting the second side 125" upward. The presence of the tension roller 125*c* enables the transfer belt 125 to maintain a state of tension.

A primary transfer roller 126 is disposed at the top of each photoconductive drum 121 oppositely via the first side 125'. The transfer belt 125 turns in synchronism with each photoconductive drum 121 while the first side 125' is pressed against the peripheral surface of each photoconductive drum 121 by the corresponding primary transfer rollers 126.

Accordingly, as the transfer belt 125 turns, a toner image in magenta is transferred on the surface thereof from the photoconductive drum 121 in the unit 12M for magenta. Subsequently, a toner image in cyan is transferred from the photoconductive drum 121 in the unit 12C for cyan on the transfer belt 125 at the same position so as to be superimposed on the formerly transferred toner image. Thereafter, a toner image in yellow and a toner image in black are sequentially transferred, respectively, from the unit 12Y for yellow and the unit 12K for black on the transfer belt 125 at the same position so as to be superimposed on the lastly transferred toner image in the same manner as above. A color toner image is thus formed on the surface of the transfer belt 125. The color toner image on the transfer belt 125 is then transferred onto a recording sheet P carried from the sheet storing portion 14.

A drum cleaning device 127 that cleans the corresponding photoconductive drum 121 by removing toner particles remaining on the peripheral surface thereof is provided at a left position of each photoconductive drum 121. The peripheral surface of the photoconductive drum 121 done with the cleaning processing by the drum cleaning device 127 heads for the charging device 123 so as to be charged anew.

Also, a belt cleaning device 128 that applies cleaning processing to the transfer belt 125 by removing residual toner particles adhering onto the surface thereof is provided on the right of the driven roller 125*b*. The peripheral surface of the transfer belt 125 done with the cleaning processing by the belt cleaning device 128 heads for the respective photoconductive drums 121.

Waste toner particles removed from the peripheral surface of each photoconductive drum 121 by the corresponding drum cleaning device 127 and the surface of the transfer belt 125 by the belt cleaning device 128 passes through a specific channel to be collected in an unillustrated toner collection bottle.

A sheet carrying path 111 extending in a vertical direction is formed at the left position of the image forming portion 12 in FIG. 1. A pair of carrying rollers 112 is provided to the sheet carrying path 111 at an adequate position. A recording sheet P extracted from the sheet storing portion 14 is carried toward the transfer belt 125 stretched over the drive roller 125*a* by the driving of the pair of carrying rollers 112.

The second transfer roller 113 that abuts on the surface of the transfer belt 125 is provided to the sheet carrying path 111 at a position opposing the drive roller 125*a*. A color toner image on the transfer belt 125 is transferred onto the recording sheet P as it is carried through the sheet carrying path 111 and nipped and pressed by the transfer belt 125 and the second transfer roller 113.

The fixing portion 13 applies fixing processing to the toner image transferred onto the recording sheet P in the image forming portion 12. The fixing portion 13 is formed of a heating roller 131 that houses inside a conducting heating element serving as a heating source, a fixing roller 132 disposed oppositely to the heating roller 131, a fixing belt 133 stretched over the fixing roller 132 and the heating roller 131, and a pressure roller 134 disposed oppositely to the fixing roller 132 via the fixing belt 133.

The recording sheet P bearing the transferred color toner image passes by a nip portion between the fixing belt 133 turning around the heating roller 131 and the fixing roller 132 in a heated state and the pressure roller 134. Accordingly, heat is transmitted from the fixing belt 133 to the recording sheet P, and the melted toner particles are firmly fixed onto the recording sheet P.

The recording sheet P bearing the color image done with the fixing processing passes through a sheet discharge path 114 provided to extend from the top portion of the fixing portion 13 to be discharged toward a sheet discharge tray 115 provided on top of the apparatus main body 11.

The sheet storing portion 14 has a sheet tray 141 attached at a position below the exposing devices 124 in the apparatus main body 11 so as to be pulled out forward (on the front side of the sheet surface of FIG. 1). A pile of recording sheets P1, in which plural recording sheets P are stacked, is stored in the sheet tray 141. Recording sheets P are fed one by one from the pile of recording sheets P1, stored in the sheet tray 141 by the driving of a pick-up roller 142 and sent toward the nip portion between the second transfer roller 113 and the transfer belt 125 in the image forming portion 12 by passing through the sheet carrying path 111.

In this embodiment, a manual tray 143 is provided on the right side surface of the apparatus main body 11, which is attached in such a manner that it can be opened and closed with respect to the apparatus main body 11 by being rotated in forward and backward directions about a supporting shaft 143*a*. The manual tray 143 is used to feed a recording sheet P of a different size from the recording sheets P stored in the sheet tray 141 or to feed only one recording sheet P.

Also, in this embodiment, a back-feed path 116 is provided on the left of the fixing portion 13. The back-feed path 116 is to feed a recording sheet P, which has passed through the sheet discharge path 114 once and is now on the point of being discharged, backward to the nip portion between the second transfer roller 113 and the transfer belt 125 for the transfer processing to be applied on the back surface of the recording sheet P. By using the back-feed path 116, it is possible to perform so-called double-side printing to transfer images on the both surfaces of a recording sheet P.

Figure 2:
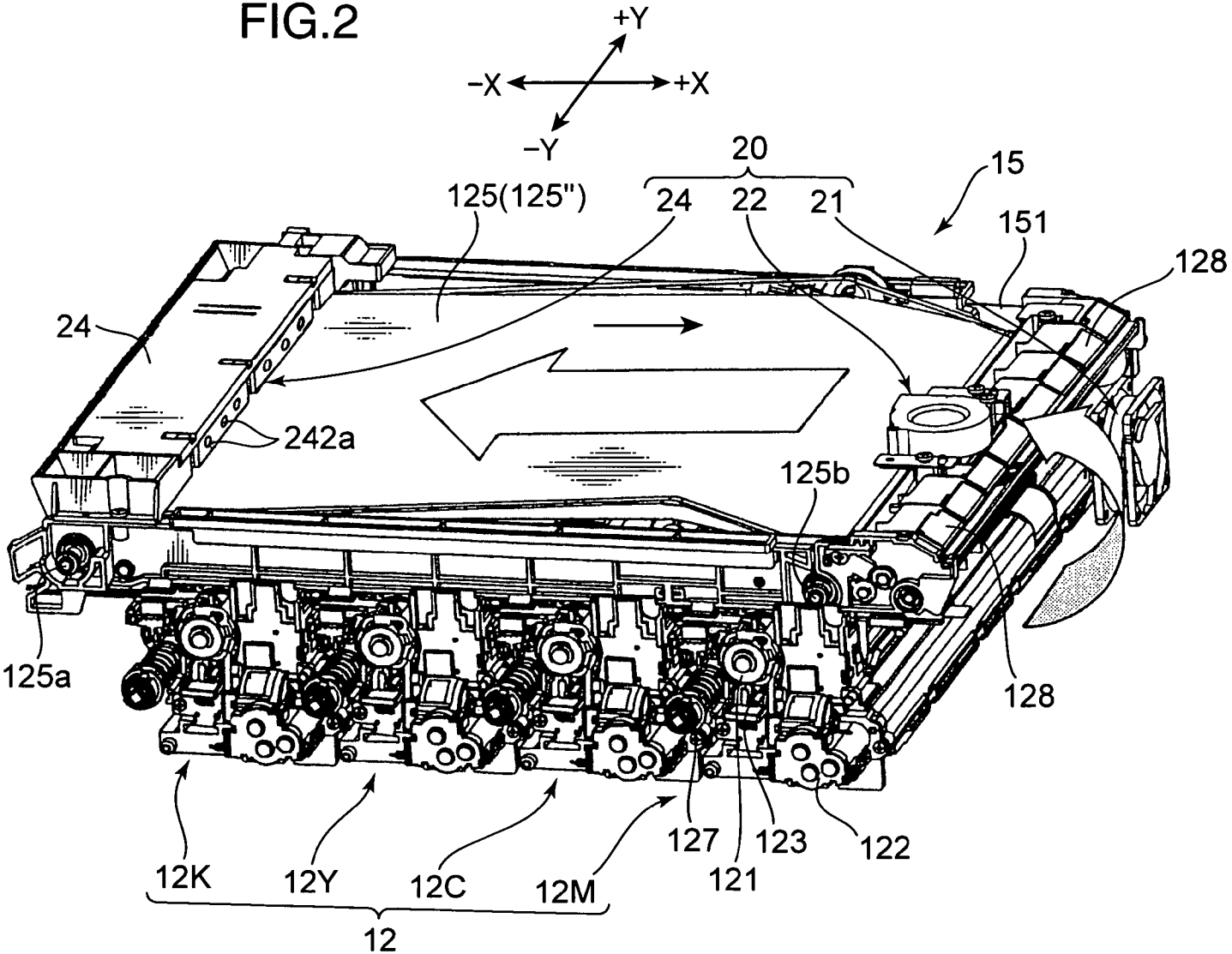
FIG. 2 is a perspective view of an image forming unit used to describe a cooling mechanism according to the embodiment.
Figure 3:
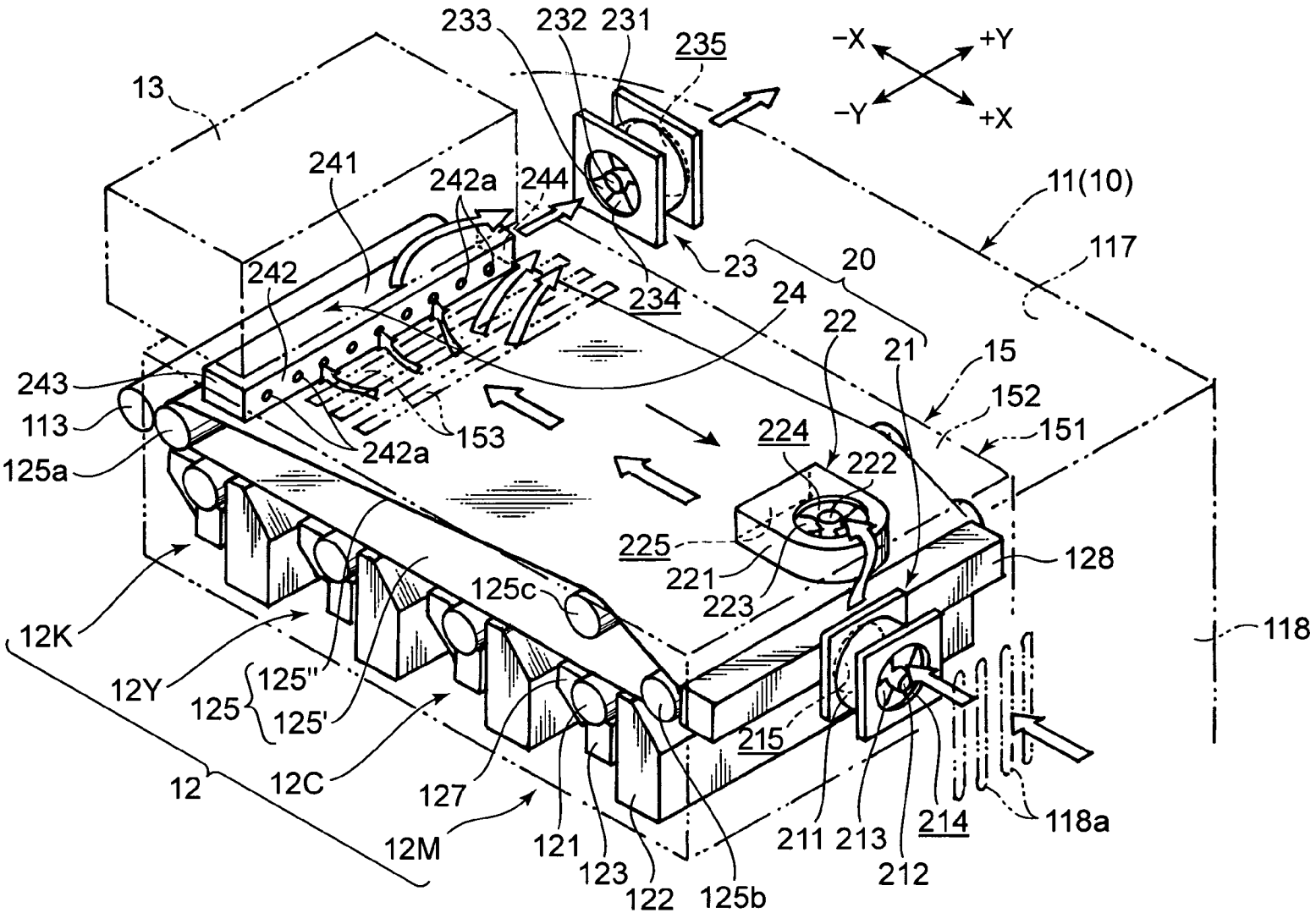
FIG. 3 is a perspective view schematically showing the image forming unit shown in FIG. 2 on a production basis.
Figure 4:
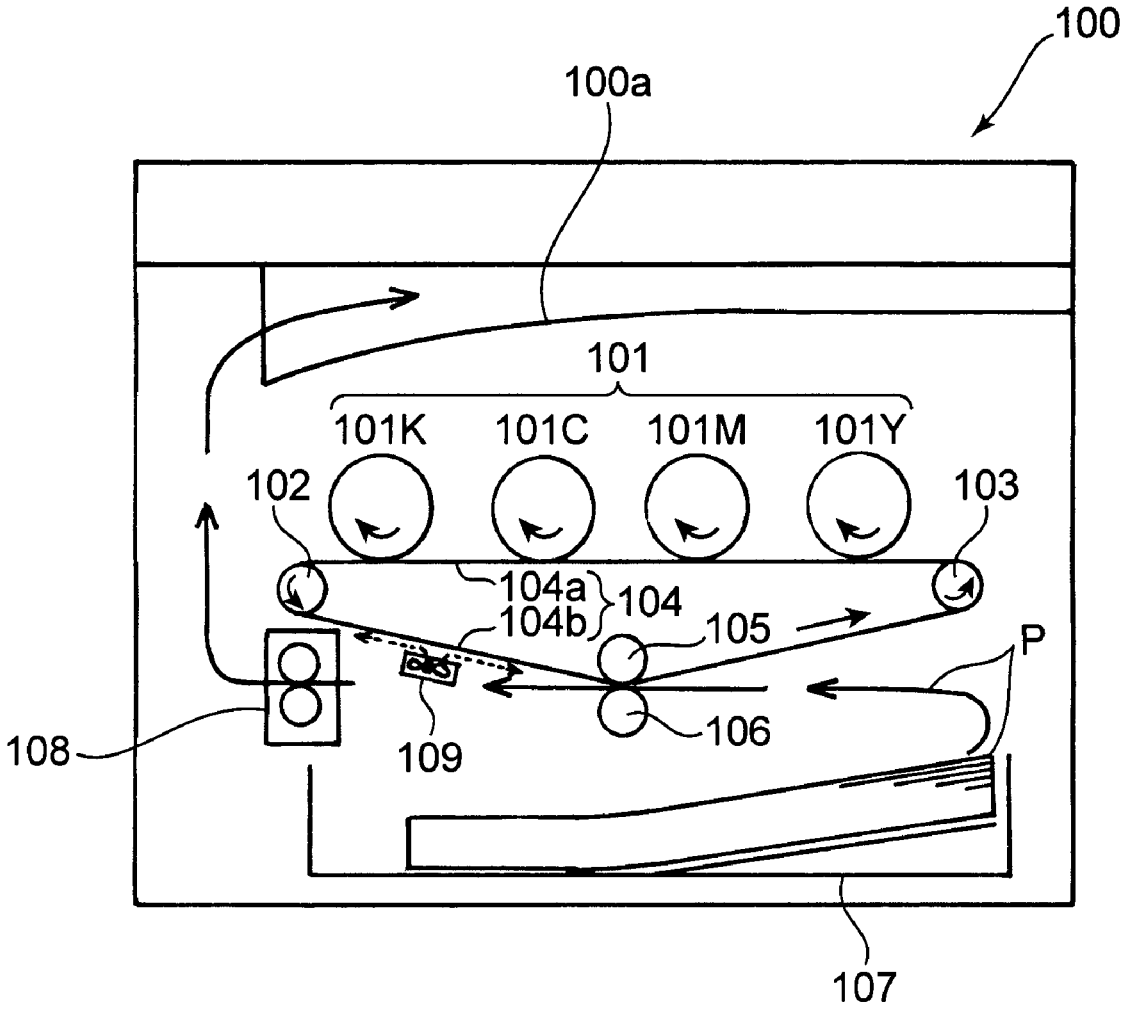
PRIOR ART FIG.4
FIG. 4 is a sectional front view of an image forming apparatus adopting a cooling mechanism in the prior art for a transfer belt.

FIG. 2 is a perspective view of one embodiment of an image forming unit 15 on a production basis to describe the cooling mechanism 20 of the invention. FIG. 3 is a perspective view schematically showing the image forming unit 15 shown in FIG. 2 on a production basis. Referring to FIG. 2 and FIG. 3, the X-X direction is defined as the right-left direction, and the Y-Y direction is defined as the front-back direction. In particular, the −X direction is defined as the left, the +X direction as the right, the −Y direction as the front, and the +Y direction as the rear.

In this embodiment, all the members used for image formation, such as the units 12M, 12C, 12Y, and 12K for respective colors and the transfer belt 125 forming the image forming portion 12, are made into a unit, and provided in the form of the single image forming unit 15. The image forming unit 15 has a skeletal frame 151 exhibiting the shape of a rectangular prism and formed of plural supporting columns extending in the top-bottom direction and disposed at the four corners when viewed in a plane and any other appropriate portion, and joist materials and beam materials bridging between adjacent supporting columns.

Photoconductive drums 121, the developing devices 122, the charging devices 123, the exposing device 124, the transfer rollers 126, and the drum cleaning devices 127 for the respective units 12M, 12C, 12Y, and 12K are attached to the interior of the skeletal frame 151. The transfer belt 125 is provided at a position above the respective photoconductive drums 121 in the skeletal frame 151, and the belt cleaning device 128 is provided to oppose the right end portion of the transfer belt 125. The cooling mechanism 20 is attached to the respective supporting columns and beam materials of the skeletal frame 151 at appropriate positions.

Hereinafter, the cooling mechanism 20 will be described with reference mainly to FIG. 2 and FIG. 3 and to FIG. 1 when the necessity arises. The cooling mechanism 20 is to apply cooling processing to the transfer belt 125. The cooling processing is applied to the transfer belt 125 in order to prevent the transfer belt 125 from being overheated above a specific temperature by heat transmitted from the photoconductive drums 121 and irradiation heat from the fixing portion 13.

To be more specific, when the temperature of the photoconductive drum 121 rises, influences of heat make it difficult to form an electrostatic latent image or a toner image appropriately on the peripheral surface of the photoconductive drum 121. A first object to apply the cooling processing to the transfer belt 125 is to prevent such an inconvenience by applying the cooling processing to the photoconductive drum 121 via the transfer belt 125 to which the peripheral surface of the photoconductive drum 121 abuts.

Also, when the transfer belt 125 is overheated, toner particles forming a toner image formed on the surface of the transfer belt 125 may melt and be firmly fixed onto the surface of the transfer belt 125. Further, the transfer belt 125, the drive roller 125*a*, the driven roller 125*b*, or the like may extend or expand due to heat, which may possibly cause an inconvenience that the image forming position on the transfer belt 125 is displaced from the original position. The cooling processing is applied to the transfer belt 125 also for a second purpose to eliminate these inconveniences.

The cooling mechanism 20 provided for these purposes is formed of a first fan device (inlet fan) 21 that takes in outside air inside the apparatus main body 11, a second fan device (inlet fan) 22 that applies the cooling processing to the transfer belt 125 using outside air taken in inside the apparatus main body 11, an exhaust fan device (exhaust fan) 23 that exhausts an air flow inside the apparatus main body 11, and a heat insulating duct member 24 that shields against heat from the fixing portion 13.

As is shown in FIG. 3, the first fan device 21 is provided on the right surface of the skeletal frame 151 at a position opposing the belt cleaning device 128. The second fan device 22 is provided on the bottom surface of a top board 152 (indicated by a chain double-dashed line in FIG. 3; because FIG. 2 shows a state where the top board 152 is removed, the top board 152 is not shown therein) of the skeletal frame 151 at a position directly above the center of the belt cleaning device 128 in the front-back direction. The exhaust fan device 23 is attached, at an upper left position of the top board 152 of the skeletal frame 151, to a backside board 117 of the apparatus main body 11 at a slightly rightward position from the fixing portion 13. Further, the heat insulating duct member 24 is interposed in a space between the drive roller 125*a* and the right end portion of the housing of the fixing portion 13.

The first fan device 21 includes a casing 211 installed in the right-left direction in a horizontal orientation, and a fan 213 attached to the interior of the casing 211. The fan 213 rotates integrally about a driving shaft 212 that extends in the right-left direction and is driven to rotate by the driving of an unillustrated driving motor. The casing 211 is provided with an inlet port 214 for taking in outside air in the right surface and an exhaust port 215 in the left surface.

Meanwhile, louvers 118*a* for taking in outside air are provided in a right surface board 118 (FIG. 3) of the apparatus main body 11 at a position opposing the first fan device 21. Hence, as the fan 213 of the first fan device 21 is driven to rotate about the driving shaft 212, outside air is introduced into the apparatus main body 11 via the louvers 118*a*. Outside air is further introduced into the image forming unit 15 via the inlet port 214 and the exhaust port 215 of the first fan device 21.

The second fan device 22 includes a casing 221 installed in a vertical orientation, and a fan 223 attached internally to the casing 221. The fan 223 rotates integrally about a driving shaft 222 that extends in the top-bottom direction and is driven to rotate by the driving of an unillustrated driving motor. The casing 221 is provided with an inlet port 224 for taking in outside air for cooling that is sent to the inside of the image forming unit 15 by the driving of the first fan device 21 in the top surface, and an exhaust port 225 for blowing outside air toward the surface of the second side 125" of the transfer belt 125 in the left surface.

Hence, as the second fan device 22 is driven while the transfer belt 125 is turning, as is indicated by a solid arrow in FIG. 2 and FIG. 3, the second side 125" of the transfer belt 125 moves from left to right (second direction). On the contrary, as is indicated by a hollow arrow in FIG. 2 and FIG. 3, an air flow for cooling is blown on the second side 125" as a counterflow from right to left (a direction opposite to the second direction) over almost the full length from the exhaust port 225 of the second fan device 22. Almost the entire surface of the second side 125" of the transfer belt 125 thus exchanges heat with an air flow for cooling as a counterflow, which enables the transfer belt 125 to be cooled effectively.

Of the outside air taken in via the louvers 118*a* by the driving of the first fan device 21, a residual air flow that did not head for the second fan device 22 flows through specific spaces defined in the respective units 12M, 12C, 12Y, and 12K from right to left to be used in the cooling processing for the respective units 12M, 12C, 12Y, and 12K, after which it is exhausted to the outside via the exhaust fan device 23.

Long holes 153 in the form of plural strips extending in the front-back direction are provided in the top board 152 at the upper left position. Part of the air flow discharged from the second fan device 22 is guided to the outside of the image forming unit 15 by passing through these long holes 153, and strikes on the right side wall of the fixing portion 13 to be used in the cooling processing for the fixing portion 13, after which it is headed for the exhaust fan device 23.

The exhaust fan device 23 is to exhaust the outside air that has been used in the cooling processing applied to the transfer belt 125 to the outside of the apparatus main body 11. The exhaust fan device 23 includes a casing 231 installed in the front-back direction in a horizontal orientation, and a fan 233 attached to the interior of the casing 231. The fan 233 rotates integrally about a driving shaft 232 that extends in the front-back direction and is driven to rotate about the shaft center by the driving of an unillustrated driving motor. The casing 231 is provided with an intake port 234 for taking in an air flow that has been used in the cooling processing in the front surface, and an exhaust port 235 in the back surface.

Hence, by driving the exhaust fan device 23, outside air that has been used in the cooling processing for the transfer belt 125 inside the image forming unit 15 is introduced into the casing 231 by passing through the inlet port 234 as it is guided by driving rotations of the fan 233, and is then exhausted to the outside via the exhaust port 235.

The heat insulating duct member 24 forms an air curtain inside thereof, which prevents heat from the fixing portion 13 from being transmitted to the transfer belt 125. The heat insulating duct member 24 is formed of a rectangular tube 241 that is long in the front-back direction. Plural air vents 242*a* aligned side by side in the front-back direction are provided in a right board 242 of the rectangular tube 241 by means of perforation. Part of an air flow for cooling blown out from the second fan device 22 is introduced into the rectangular tube 241 through these air vents 242*a*.

The front end portion of the rectangular tube 241 of the heat insulating duct member 24 is closed by a partition board 243, whereas the rear end portion is left open to form an exhaust port 244. Accordingly, the air flow introduced into the rectangular tube 241 by passing through the air vents 242*a* forms a heat shielding air curtain, after which it heads for the exhaust fan device 23 by passing through the exhaust port 244.

By interposing the heat insulating duct member 24 configured as above in a space between the fixing portion 13 and the upstream end (left side) of the second side 125", it is possible to prevent heat generated in the fixing portion 13 from heading for the transfer belt 125 as it is shielded by the air curtain that flows inside the heat insulating duct member 24. It is therefore possible to prevent migration of heat from the fixing portion 13 as a heat source having the largest heating value in the apparatus main body 11 to the transfer belt 125, which can in turn prevent effectively the transfer belt 125 from being overheated.

As has been described in detail, the printer 10 of this embodiment has the transfer belt 125 that turns around the drive roller 125*a* and the driven roller 125*b* and is disposed in such a manner that the surface of the first side 125' abuts on the peripheral surfaces of the plural photoconductive drums 121 for the respective colors aligned side by side. A color image made of toners in respective colors superimposed one on another is formed on the surface of the transfer belt 125, and the color image is transferred onto a recording sheet P at the position of the second transfer roller 113.

In addition, the cooling mechanism 20 that applies the cooling processing to the transfer belt 125 is provided. According to this cooling mechanism 20, because taken-in outside air is flown along the surface of the second side 125" of the transfer belt 125, the second side 125" is cooled through contact with the outside air blown thereon along almost the full length by the cooling mechanism 20. In comparison with a case in the conventional art where the outside air is supplied to only a half of the lower side 104*b*, it is possible to apply the cooling processing to the transfer belt 125 at efficiency increased by about two times.

As the cooled transfer belt 125 abuts on the peripheral surface of the photoconductive drum 121, it is possible to cool the photoconductive drum 121 appropriately, which in turn makes it possible to prevent effectively the occurrence of an inconvenience such that gives adverse influences to the image forming processing. In addition, it is possible to prevent residual toner particles on the transfer belt 125 from melting and being firmly fixed thereon.

Because the transfer belt 125 is disposed on the upper side of the respective photoconductive drums 121, it is possible to secure a space sufficiently large enough to open the entire surface of the second side 125" of the transfer belt 125 at the upper portion in the apparatus main body 11. This allows the second side 125" to be brought in a state where outside air is readily blown across the entire surface thereof, which is advantageous in applying the cooling processing effectively to the transfer belt 125. In addition, because the air flow that has been used in the cooling processing is forcedly exhausted to the outside by the driving of the exhaust fan device 23, the air flow for cooling will not stagnate inside the apparatus main body 11. It is thus possible to constantly supply the transfer belt 125 with fresh outside air for cooling.

The cooling mechanism 20 is formed of the first and second fan devices 21 and 22 that are provided at the downstream end in the moving direction of the second side 125" and take in outside air to blow the outside air on the second side 125", and the exhaust fan device 23 that is provided at the upstream end in the moving direction of the second side 125". Hence, the first and second fan devices 21 and 22 blow outside air as a counterflow on the second side 125" of the turning transfer belt 125 that is turning, which makes the cooling effect to the transfer belt 125 larger.

Further, the heat insulating duct member 24 that forms an air curtain in the inside receiving an air flow discharged from the second fan device 22 is interposed in a space between the fixing portion 13 disposed at an upper position at the upstream end in the moving direction of the second side 125" and the transfer belt 125. Hence, heat generated from the fixing portion 13 is constantly removed by the air curtain that is constantly renewed with a fresh air flow supplied to the inside of the heat insulating duct member 24. It is thus possible to effectively prevent the transfer belt 125 from being heated by heat from the fixing portion 13 that is the largest heat generating source in the apparatus main body 11.

It should be appreciated that the invention is not limited to the embodiment above, and the invention includes the contents as follows.

(1) The embodiment above described the printer 10 as an example of the image forming apparatus to which the cooling mechanism 20 is applied. It goes without saying, however, that the invention is also applicable to a copying machine, a facsimile machine, and so forth.

(2) The embodiment above described an example of the image forming apparatus (printer 10 in the embodiment above) used for color printing that adopts the unit 12Y for yellow, the unit 12M for magenta, the unit 12C for cyan, and the unit 12K for black. However, the image forming apparatus may be used for so-called monochromatic printing by adopting the unit 12K for black alone.

Alternatively, even in the image forming apparatus for color printing, the unit 12K for black may be omitted, so that the image forming portion 12 is formed of the unit 12Y for yellow, the unit 12M for magenta, and the unit 12C for cyan alone. In this case, an image in black is formed by superimposing toners in yellow, magenta, and cyan one on another.

(3) The embodiment above has described a case where the first and second fan devices 21 and 22 are adopted as the inlet fans for the reason of layout limits of the apparatus main body 11. However, either one of the first and second fan devices 21 and 22 may be omitted depending on the situations. Conversely, in addition to the first and second fan devices 21 and 22, a total of three or more inlet fan devices may be provided.

(4) In the embodiment above, outside air for cooling is supplied to the second side 125" of the transfer belt 125 by the second fan device 22 provided on the belt cleaning device 128 side. However, it may be configured in such a manner that outside air is blown toward the center of the second side 125" or blown toward the upstream end of the second side 125" depending on the situations.

(5) In the embodiment above, plural long holes 153 are provided in the top board 152 of the image forming unit 15 at the left side portion, and part of the air flow discharged from the second fan device 22 is introduced through these long holes 153 and headed for the fixing portion 13 so as to be used in the cooling processing for the fixing portion 13. However, in a case where a special fan for applying the cooling processing to the fixing portion 13 is provided, it is not particularly necessary to provide the long holes 153 in the top board 152 of the image forming unit 15 for supplying the fixing portion 13 with an air flow for cooling.

The concrete embodiment described above contains inventions having the configurations as follows.

An image forming apparatus according to one aspect of the invention includes: plural photoconductive drums aligned side by side for toner images in respective colors to be formed on peripheral surfaces thereof; a transfer belt configured to turn while being stretched over a specific number of rollers for the respective toner images to be transferred thereon by being superimposed one another as a surface thereof abuts on the peripheral surfaces of the respective photoconductive drums; a transfer roller configured to transfer the toner images having been transferred onto the surface of the transfer belt onto a recording sheet; and a cooling mechanism configured to apply cooling processing to the transfer belt using taken-in outside air, wherein the transfer belt uses a position at which the transfer roller is disposed as a turning position and is turned to have a first side that moves in a first direction heading for the turning position while abutting on the peripheral surfaces of the respective photoconductive drums and a second side that moves in a second direction opposite to the first direction using the turning position as a starting point, and the cooling mechanism applies the cooling processing to the transfer belt by circulating the taken-in outside air along a surface of the second side.

According to this configuration, because outside air is circulated along the second side of the transfer belt by the cooling mechanism, the second side is cooled through contact with the outside air along almost the full length without being disturbed by the transfer roller. The cooling processing can be therefore applied efficiently to the transfer belt. Hence, because the photoconductive drum can be cooled appropriately as the transfer belt cooled in this manner abuts on the peripheral surface of the photoconductive drum, it is possible to prevent the occurrence of an inconvenience such that gives adverse influences to the image forming processing. In addition, it is also possible to effectively prevent residual toner particles on the transfer belt from melting and being firmly fixed thereon.

In the configuration described above, it is preferable that the transfer belt is disposed at an upper side of the photoconductive drums. According to this configuration, it is possible to secure a space sufficiently large enough to open the entire surface of the second side of the transfer belt, which allows the second side to be brought in a state where outside air is readily blown across the entire surface thereof.

In the configuration described above, it is preferable that the cooling mechanism circulates outside air in a direction opposite to the second direction. According to this configuration, because an air flow for cooling is blown on the second side as a counterflow, the cooling effect can be enhanced.

In this case, it is preferable that the cooling mechanism includes an inlet fan provided at a downstream end in a moving direction of the second side of the transfer belt and configured to take in outside air to blow the outside air on the second side, and an exhaust fan provided on an upstream end in the moving direction of the second side.

According to this configuration, because an air flow that has been used in the cooling processing is exhausted to the outside by the driving of the exhaust fan, outside air taken in by the inlet fan will not stagnate inside the image forming apparatus, and fresh outside air is constantly supplied to the transfer belt, which enables the transfer belt to be cooled effectively.

In the configuration described above, it is preferable to further include a fixing portion provided at an upper position at the upstream end in the moving direction of the second side and configured to apply fixing processing by heating to the recording sheet done with transfer processing, and a heat insulating duct member provided in a space between the fixing portion and the second side and configured to shield against heat from the fixing portion by forming an air curtain inside thereof by receiving an air flow discharged from the inlet fan.

According to this configuration, heat generated in the fixing portion is constantly removed by the air curtain that is constantly renewed by a fresh air flow provided to the inside of the heat insulating duct member. It is thus possible to prevent the transfer belt from being overheated by heat from the fixing portion as the largest heat generating source in the image forming apparatus.

This application is based on patent application No. 2006-060687 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to be embraced by the claims.

What is claimed is:

1. An image forming apparatus, comprising:

plural photoconductive drums aligned side by side for toner images in respective colors to be formed on peripheral surfaces thereof;

a transfer belt configured to turn while being stretched over a specific number of rollers for the respective toner images to be transferred thereon by being superimposed one on another as a surface thereof abuts on the peripheral surfaces of the respective photoconductive drums;

a transfer roller configured to transfer the toner images having been transferred onto the surface of the transfer belt onto a recording sheet; and a cooling mechanism configured to apply cooling processing to the transfer belt using taken-in outside air, wherein:

the transfer belt uses a position at which the transfer roller is disposed as a turning position and is turned to have a first side that moves in a first direction heading for the turning position while abutting on the peripheral surfaces of the respective photoconductive drums and a second side that moves in a second direction opposite to the first direction using the turning position as a starting point; and the cooling mechanism applies the cooling processing to the transfer belt by circulating the taken-in outside air along a surface of the second side.

2. The image forming apparatus according to claim 1, wherein:

the transfer belt is disposed at an upper side of the photoconductive drums.

3. The image forming apparatus according to claim 1, wherein:

the cooling mechanism circulates outside air in a direction opposite to the second direction.

4. The image forming apparatus according to claim 3, wherein the cooling mechanism includes:

an inlet fan provided at a downstream end in a moving direction of the second side of the transfer belt and configured to take in outside air to blow the outside air on the second side; and an exhaust fan provided at an upstream end in the moving direction of the second side.

5. The image forming apparatus according to claim 4, further comprising:

a fixing portion provided at an upper position at the upstream end in the moving direction of the second side and configured to apply fixing processing by heating to the recording sheet done with transfer processing; and a heat insulating duct member provided in a space between the fixing portion and the second side and configured to shield against heat from the fixing portion by forming an air curtain inside thereof by receiving an air flow discharged from the inlet fan.

* * * * *